US006364262B1

(12) United States Patent
Gibson et al.

(10) Patent No.: US 6,364,262 B1
(45) Date of Patent: Apr. 2, 2002

(54) DISPLAY ASSEMBLY

(75) Inventors: Scott S. Gibson, Mercer Island; Spec Fulmar, Kent, both of WA (US)

(73) Assignee: Burke Gibson, Inc., Auburn, WA (US)

( * ) Notice: Subject to any disclaimer, the term of this patent is extended or adjusted under 35 U.S.C. 154(b) by 0 days.

(21) Appl. No.: 09/411,780

(22) Filed: Oct. 1, 1999

(51) Int. Cl.[7] ..... G09F 7/18
(52) U.S. Cl. ..... 248/229.14; 248/229.24
(58) Field of Search ..... 248/229.14, 229.15, 248/229.2, 229.22, 229.24, 229.25, 229.21, 74.1, 68.1, 201, 205.1, 220.21, 220.41, 229.16, 229.26, 228.6, 228.7, 228.5

(56) References Cited

U.S. PATENT DOCUMENTS 2,787,433 A * 4/1957 Slavsky et al. ..... 248/231.71
3,529,798 A * 9/1970 Williams et al. ..... 248/125.1
4,307,864 A * 12/1981 Benoit ..... 248/229.24
4,736,921 A * 4/1988 Zane et al. ..... 248/316.2
4,909,464 A * 3/1990 Levine et al. ..... 248/220.22
5,039,048 A * 8/1991 Paxton ..... 248/229.24
5,435,097 A * 7/1995 Harper ..... 248/229.2
5,722,623 A * 3/1998 Gibson ..... 248/201
5,941,483 A * 8/1999 Baginski ..... 248/68.1
5,984,243 A * 11/1999 Pfaller et al. ..... 248/74.1

* cited by examiner

*Primary Examiner*—Ramon O. Ramirez
*Assistant Examiner*—A. Joseph Wujciak
(74) *Attorney, Agent, or Firm*—Delbert J. Barnard

(57) ABSTRACT

An upper clamp part (24) includes a downwardly directed upper clamp jaw (28). A lower clamp part (26) includes an upwardly directed lower clamp jaw (30). The upper and lower clamp parts (24, 26) are adapted to be connected together by a screw fastener (32), with a member positioned between the upper and lower clamp jaws. The screw fastener (32) connects the upper and lower clamp parts (24, 26) together and moves their clamp jaws (28, 30) into clamping engagement with the member (20, 22). The clamp parts (24, 26) include outboard portions that maybe sections of a T-bar (14, 52). When the clamp parts (24, 26) are connected together, and are clamped onto the member, the T-bar sections are in axial alignment.

20 Claims, 6 Drawing Sheets

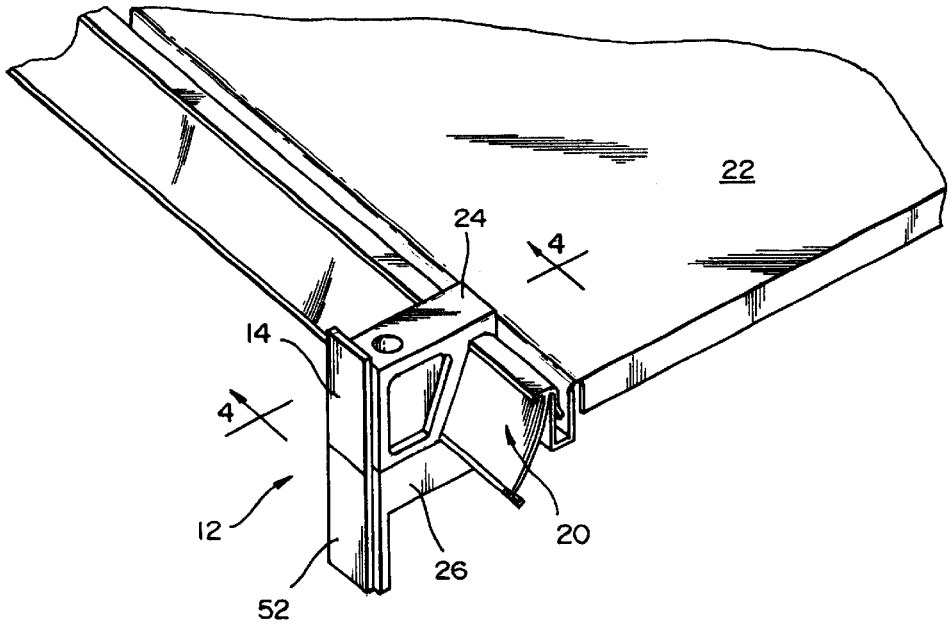
FIG. 2
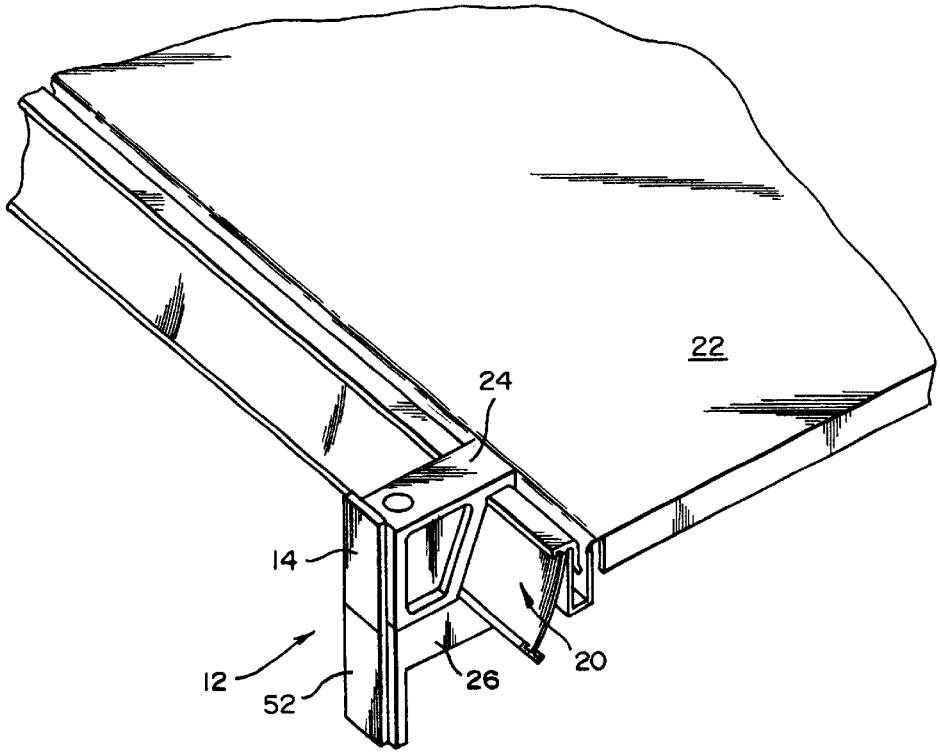

FIG. 5
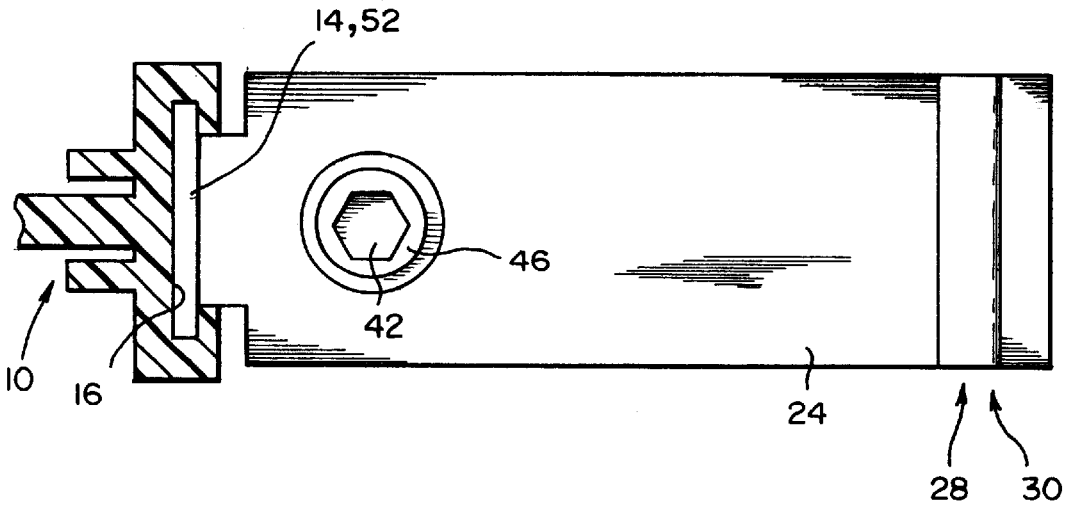
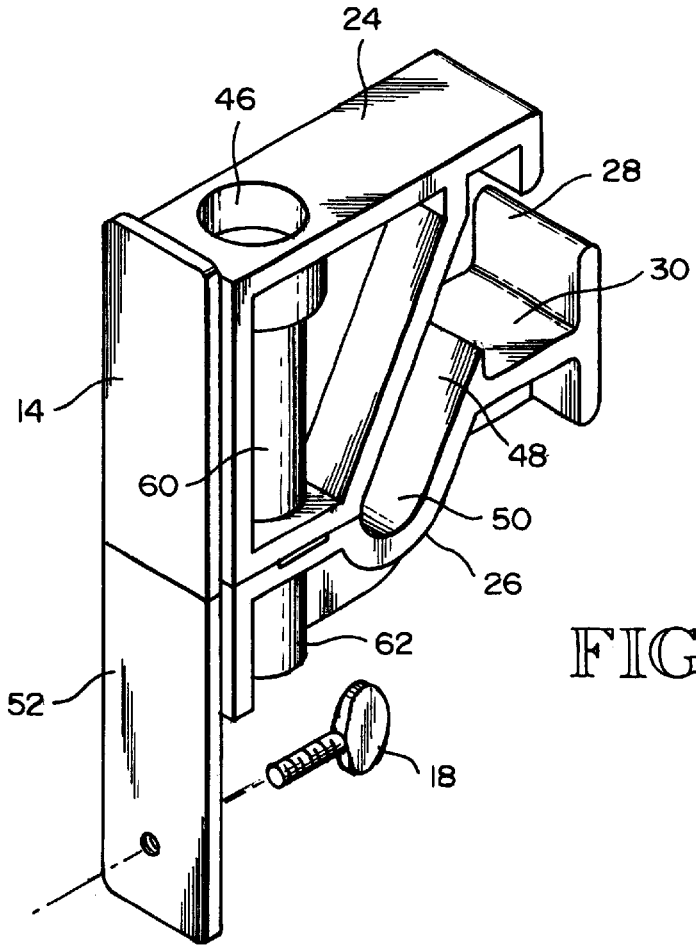
FIG. 7

DISPLAY ASSEMBLY

TECHNICAL FIELD

This invention relates to the provision of an improved mounting bracket that is adapted to clamp onto a shelf structure, for example, and mount a display holder onto such structure.

BACKGROUND INFORMATION

Background information is set forth in U.S. Pat. No. 5,419,134, granted May 30, 1995 to Scott S. Gibson, and entitled, Display Holder, and in U.S. Pat. No. 5,722,623, granted Mar. 3, 1998, also to Scott S. Gibson, and entitled Upright Display Assembly. U.S. Pat. No. 5,722,623 discloses a particular shelf structure that includes a rail facing. The preferred embodiment of the present invention is especially adapted for connection to such a rail facing.

An object of the invention is to provide a mounting bracket that can be easily and quickly clamped onto a support structure and when on the support structure will provide a stable mounting structure onto which a display holder, or other structure can be mounted.

BRIEF SUMMARY OF THE INVENTION

The present invention includes several novel structures and structural orientations that are exemplified by the disclosed embodiments.

The present invention includes the provision of a mounting bracket that is characterized by an upper clamp part having a downwardly directed upper clamp. jaw, and a lower clamp part having an upwardly directed lower clamp jaw. The upper and lower clamp parts are adapted to be connected together with the lower clamp jaw vertically confronting the upper clamp jaw. A member on to which the mounting bracket is to be mounted is positioned between the upper and lower clamp jaws. Then, the upper and lower clamp parts are connected together to clamp them onto said member.

According to an aspect of the invention, at least one of the clamp parts includes an outboard portion to which an object to be mounted is connected.

According to another aspect of the invention, the upper and lower clamp parts are connected together by a screw fastener. The upper clamp part includes a first vertical opening. The lower clamp part includes a second vertical opening that is in vertical alignment with the first vertical opening when the two clamp parts are together. A screw fastener extends through the two openings.

According to a further aspect of the invention, one of the openings includes an outer end portion that is in the nature of a countersink that is adapted to receive an enlarged head that is at one end of the screw fastener.

According to yet another aspect of the invention, one of the openings includes internal threads and the screw fastener includes external threads that mate with the internal threads. The clamp part that includes the internal threads may include an embedded nut having an opening that is internally threaded.

According to still another aspect of the invention, the mounting bracket includes a mortise and tenon joint where the upper clamp part meets the lower clamp part. This joint is positioned to prevent rotation of one clamp part relative to the other clamp part when the clamp parts are connected together by the screw fastener.

The present invention includes providing at least one of the clamp parts with an outboard portion to which a member to be mounted is secured.

According to one aspect of the invention, the outboard portion is a T-bar that is oriented to extend substantially vertically when the mounting bracket is clamped onto the member. In preferred form, each clamp part includes a section of an elongated T-bar. When the two clamp parts are connected together, the two T-bar sections are in axial alignment together and form a single elongated T-bar.

According to a further aspect of the invention, the upper clamp part includes an upper space and the lower clamp part includes a lower space. These spaces together accommodate the member that is positioned between the upper and lower clamp jaws, onto which the mounting bracket is clamped.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWINGS

In the drawings, like element designations refer to like parts throughout the several views and:

FIG. 2 is a pictorial view showing fragmentary portions of two shelves, and showing the brackets clamped onto front edge structures on the shelves, such view being taken from above and looking down on the top, the front edge and one end of each shelf;

FIG. 5 is a top plan view of the mounting bracket, including a fragmentary sectional view of the display holder, such view being taken substantially along line 5—5 of FIG. 3, but omitting the shelf structure;

FIG. 7 is a is a pictorial view of the mounting bracket shown by FIG. 6, but in an assembled position, such view being taken from above and looking towards the top, the opposite side from FIG. 6 and the front end;

DETAILED DESCRIPTION OF THE INVENTION

Figure 1:
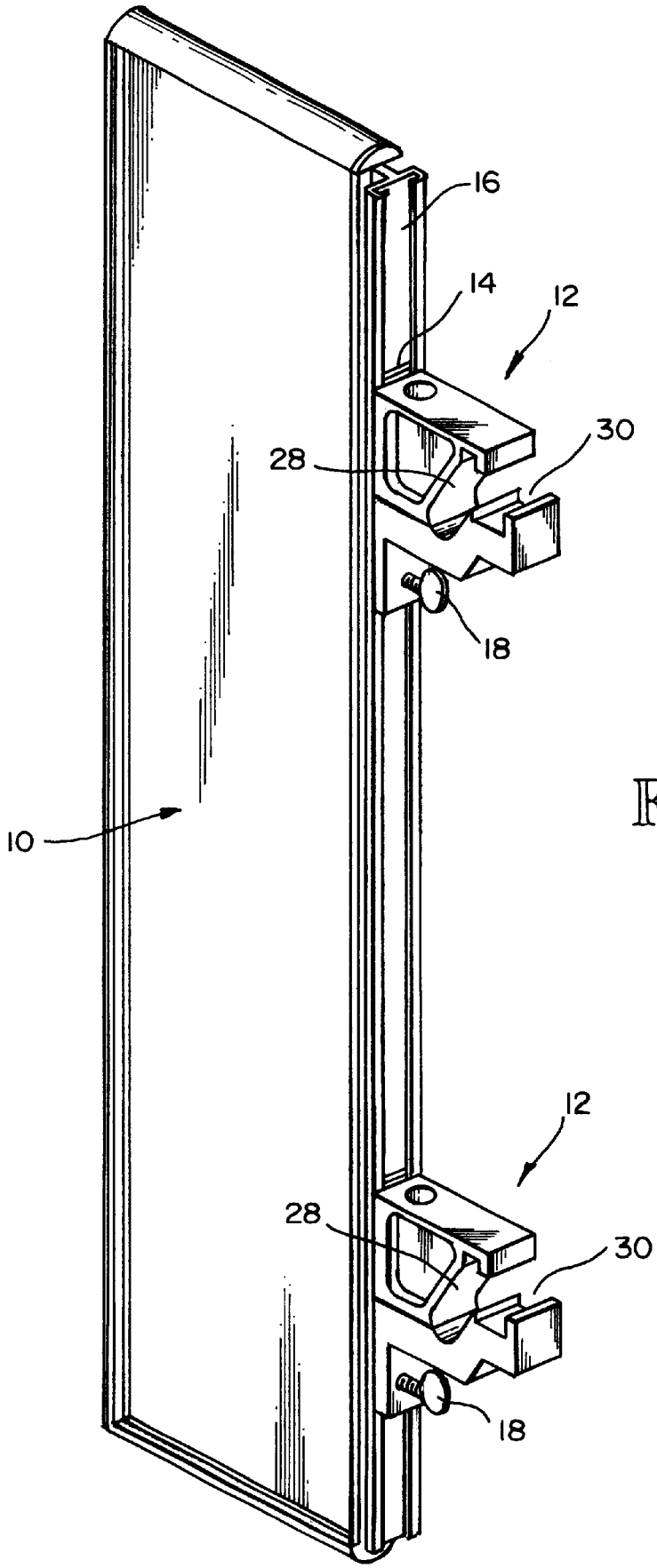
FIG. 1 is a pictorial view of a display holder and two mounting brackets that incorporate the invention, such view being taken from above and towards the top, one side and the rear edge of the display holder.

FIG. 1 shows a display holder 10 equipped with a pair of vertically spaced apart mounting brackets 12 that exemplify the present invention. As will hereinafter be explained in greater detail, each mounting bracket 12 includes a T-bar 14 that fits within a T-groove 16 that is a part of the rear edge portion of the display holder 10. Each T-bar 14 fits snugly within the T-slot 16. A set screw 18 firmly connects each bracket 12 to the rear portion of the display holder.

Figure 4:
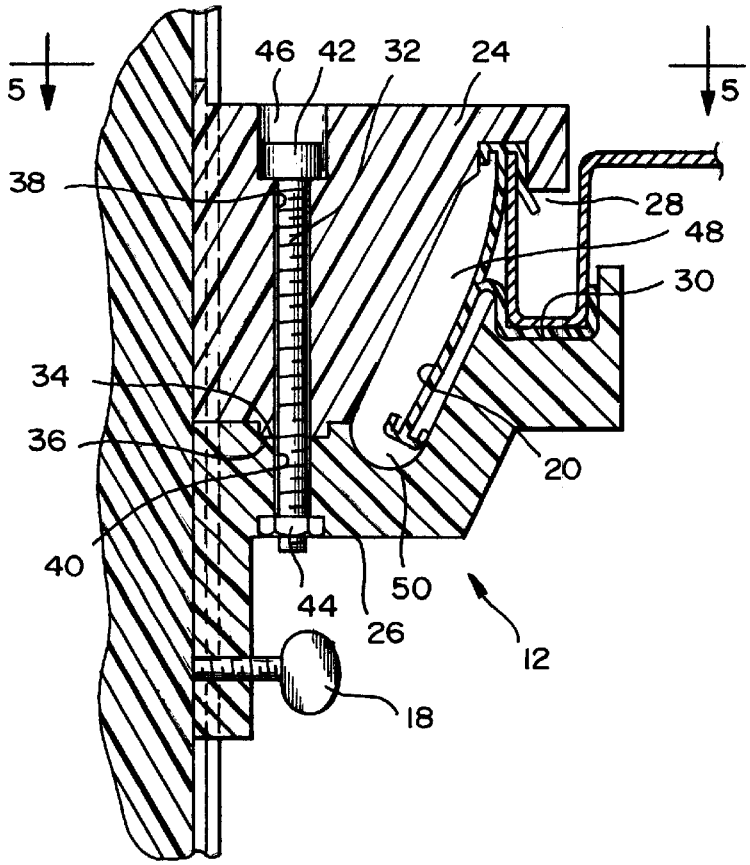
FIG. 4 is a vertical sectional view, taken substantially along line 4—4 of FIG. 2.

As best shown by FIG. 1, each mounting bracket 12 includes an outboard portion that is connected to the display holder or some other object. In the illustrated embodiment, it is connected by the T-bar 14, the T-slot 16 and the set screw 18. As best shown by FIG. 2, each mounting bracket 12 has an inboard portion that clamps onto a supporting structure for the mounting bracket 12. In FIGS. 2 and 4, this supporting structure is shown in the form of a front edge trim structure 20 for a shelf 22.

FIG. 1 shows the outboard portions of the mounting brackets 12 connected to a display holder, with the shelf structure 20, 22 omitted. FIG. 2 shows the inboard portions of the mounting brackets 12 connected to the shelf structure 20, 22, with the display holder omitted.

Figure 3:
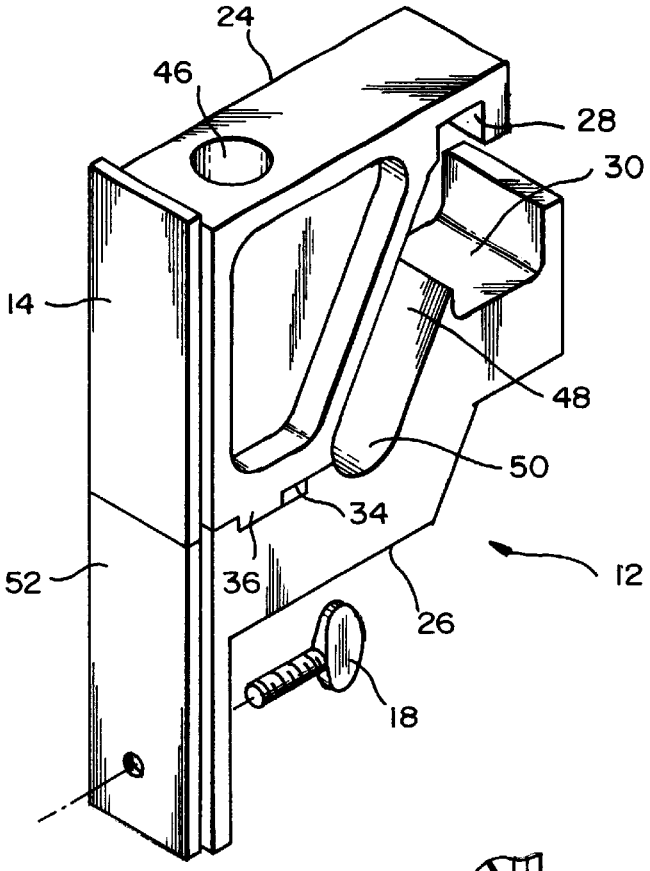
FIG. 3 is an enlarged scale pictorial view of the mounting bracket, shown in the same aptitude in which it is shown in FIG. 2.

Referring to FIGS. 3 and 4, the mounting bracket 12 is shown to comprise an upper clamp part 24 and a lower clamp part 26. The upper clamp part 24 includes a downwardly directed upper clamp jaw 28. The lower clamp part 26 includes an upwardly directed lower clamp jaw 30. The clamp parts 24, 26 are connected together by a screw 32 (FIG. 4). Preferably, one of the clamp parts 24, 26 includes a mortise 34 and the other includes an tenon 36, together forming a mortise and tenon joint 34, 36 where the two parts 24, 26 join. By way of typical and therefore non-limitive example, FIG. 4 shows the mortise 34 in part 26 and the tenon 36 depending from part 24. The mortise and tenon joint 34, 36 presents parallel lock surfaces that extend perpendicular to the general planes of the clamp parts 24, 26. When the tenon 36 is in the mortise 34, the opening 38 in part 24 is in axial alignment with the opening 40 in part 26. Also, part 26 is held against rotation relative to part 24.

Preferably, one of the openings 38, 40 includes an enlarged outer end portion that serves to countersink a head 42 at one of bolt 32. The opposite end portion of bolt 32 is threaded. Its threads thread into the internal threads of a nut 44 that is embedded into the second clamp part at the outer end of the opening in that clamp part. In the embodiment of FIGS. 3 and 4, the countersink 46 is at the outer end of opening 38. The nut 44 is embedded into the outer end of opening 40.

In the illustrated embodiment, the upper clamp part 24 includes an upper space 48 that is closely adjacent the upper clamp jaw. The lower clamp part 26 includes a lower space 50 that is laterally adjacent the lower clamp jaw 30. The two spaces 48, 50 are shaped and positioned to receive the front edge structure 20 on the shelf 22 when the upper and lower clamp parts 28, 30 are in clamping engagement with portions of the front edging and shelf structure 20, 22 In preferred form, at least one of the clamp parts 24, 26 includes an outboard portion to which a display holder, or the like, is connected. By way of example, clamp part 24 may include an outboard portion in the form of a T-bar section 52. In preferred form, clamp part 26 also includes an outboard portion in the form of a T-bar 54. When the two clamp parts 24, 26 are connected together, the T-bar sections 52, 54 together form a single elongated T-bar.

FIG. 5 is a plan view showing the T-bar 14, or 52, or 14, 52 within the T-slot 16 formed in the rear edge portion of the display holder 10. The T-bar 14, or 52, or 14, 52 makes a snug fit within the T-slot 16, but is slidable lengthwise in the T-slot 16. The set screw 18 is tightened to hold each mounting bracket 12 into position relative to the display holder.

Herein, the term "T-bar" means a structure that has a narrow portion positioned inwardly of a wider outside portion. The term "T-slot" means a slot having a narrow portion inside of a wider outside portion. The wider outside portion of the "T-bar" must be shaped and sized so that it will fit into the wider outside portion of the "T-slot." However, it is not necessary that these portions have a substantially rectangular shape as is illustrated.

Figure 6:
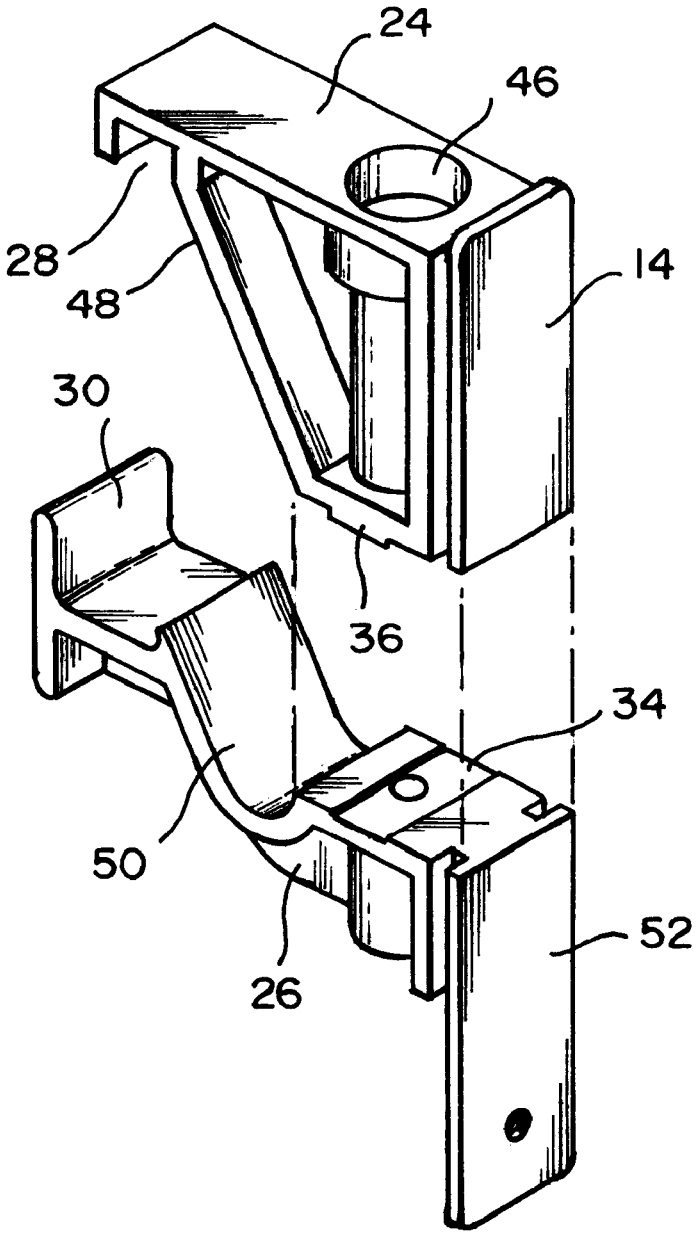
FIG. 6 is a pictorial *view of a modified form of the mounting bracket, showing the upper and lower parts of the brackets spaced apart, such view being taken from above and looking towards the top, one side and the front end of the bracket.

FIGS. 6 and 7 show a modified construction of the mounting bracket 12. It includes upper and lower tubular portions 60, 62 which house the openings 38, 40 and the nut 44. Tubular section 20 is a part of clamp part 24. It houses opening 38 and countersink 46. Tubular portion 62 is a part of clamp part 26. It houses opening 40 and nut 44.

In some installations, the countersink 46 can be omitted and it may not be necessary to either use a nut 44 or, if used, it may not be necessary to inset it into part 26. Thus, the bolt 32 may have a head that bears down on top of the upper part 24 and a nut 44 that bears on a lower portion of the part 26. Or, opening 40 of part 26 may be internally threaded.

As shown by the cross hatching, the display holder 10 and the mounting bracket parts 24, 26 are preferably constructed from structural plastic. However, if desired, these parts could be made from metal, or part metal and part plastic.

FIGS. 15 and 17 of U.S. Pat. No. 5,419,134 show a trunnion mounted display holder. FIG. 15 shows upper and lower members 154, 158 which include a plurality of trunnion receiving openings 152, 156. Members like members 154, 158 can be incorporated into the clamp parts 24, 26 For example, the horizontal portions of members 154, 158 may be formed with a portion that extends over the top of an is secured to the top of the parts 24 of two different mounting brackets 12. The portions of the members 154, 158 that include the openings 152, 156 would then project forwardly from the bracket part 24. Each upper opening would receive an upper trunnion and each lower opening would receive a lower trunnion.

Figure 8:
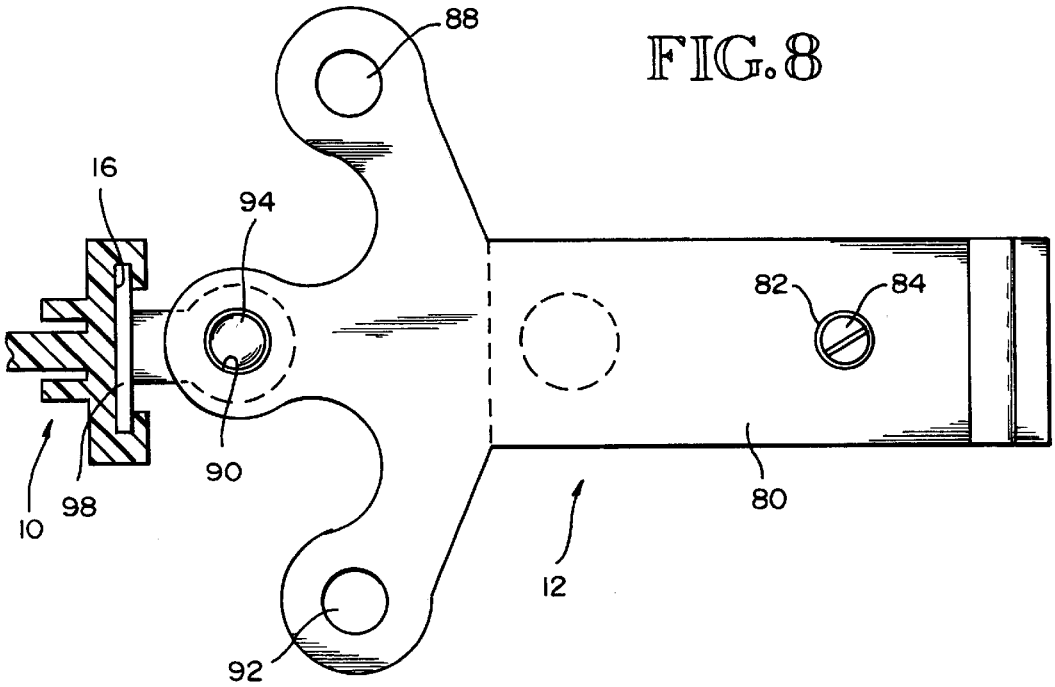
FIG. 8 is a top plan view of a mounting bracket, such view including a cross-sectional view of a fragmentary inner edge portion of a display holder, such view being taken substantially along line 8—8 of FIG. 9.
Figure 9:
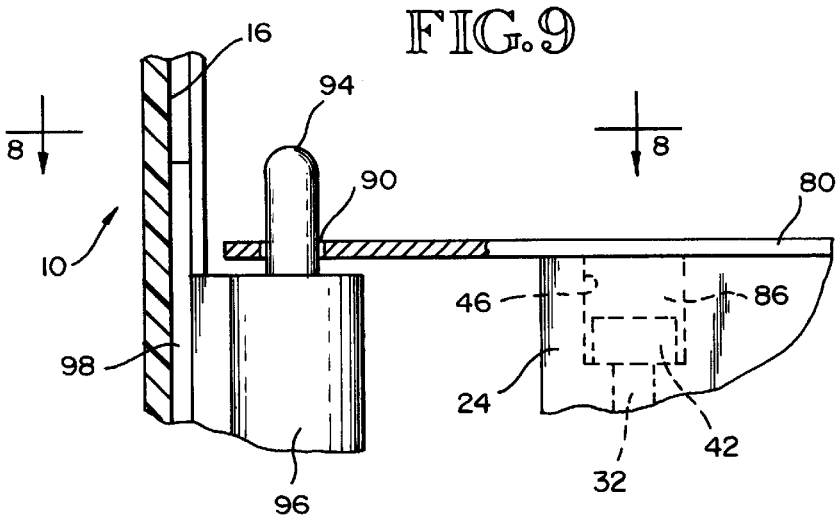
FIG. 9 is a fragmentary view that is partially in side elevation and partially in section, such view showing an upper trunnion that is connected to an upper rear portion of a display holder, such trunnion extending through a vertical opening in a plate member that is attached to the top of a mounting bracket.

FIGS. 8 and 9 show an example trunnion mount. A plate 80, shown in plan in FIG. 8, is secured to the top of an upper clamp part 24. This particular embodiment of the upper clamp part 24 does not include a T-bar component. Plate 80 may include an opening 82 for a screw 84, used to connect the plate 80 to the top of clamp part 24. Plate 80 may also include a downwardly depending element 86 that fits within the opening 46 above the head 42 of the screw fastener 32. The fit of member 86 within the opening 46, together with the screw fastener 84, secures the plate 80 to the top of clamp part 24. In the illustrated embodiment, the clamp part 80 includes three trunnion receiving openings 88, 90, 92. A trunnion 94 is shown within opening 90. The trunnion 94 is at the top of a member 96 that is connected to a T-bar 98 that fits within the T-slot 16 in the display holder 10. The display holder 10 may be provided with two trunnion assemblies 94, 96, 98. The first has its trunnion 94 projecting upwardly. The second has its trunnion 94 projecting downwardly. Two mounting brackets are connected to two shelves or other suitable structure, such as shown by FIG. 2. The vertical spacing of the shelves or other objects establishes the vertical positions of the plates 80. The trunnion assemblies 94, 96, 98 are movable within the T-slot 16 so as to place the trunnions 94 in two vertically aligned openings, e.g. openings 90. Then, the trunnion assemblies 94, 96, 98 are secured in position relative to the display holder 10, such as by use of a set screw like set screw 18. The other trunnion holes 88, 92 can receive trunnions 94 that are a part of trunnion assemblies 94, 96, 98 that are secured to other display holders 10.

The present invention is not dependent on any particular connection structure at the outboard ends of the mounting brackets 12. This structure can vary.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A display assembly, comprising:

a horizontally disposed shelf having a forward edge rail;

a vertically disposed display member positioned forwardly of the edge rail; and a mounting bracket comprising:

an upper clamp part including a downwardly directed upper clamp jaw;

a separate lower clamp part including an upwardly directed lower clamp jaw;

said upper and lower clamp parts being adapted to be connected together with the lower clamp jaw confronting the upper clamp jaw;

at least one of the clamp parts including an outboard portion;

wherein said edge rail is positioned between the upper and lower clamp jaws and the upper and lower clamp parts are detachably connected together to clamp them on to said edge rail, with said outboard portion positioned forwardly of the edge rail; and wherein said vertical display member is connected to said outboard portion.

2. The display assembly of claim 1, comprising a screw fastener for connecting the upper clamp part to the lower clamp part.

3. The display assembly of claim 2, comprising a first opening in the upper clamp part, and a second opening in the lower clamp part that is in alignment with the first opening when the two clamp parts are together, and wherein the screw fastener extends through both of these openings.

4. The display assembly of claim 2, comprising a mortise and tenon joint where the upper clamp part meets the lower clamp part, positioned to prevent rotation of one clamp part relative to the other clamp part when the clamp parts are connected together by the screw fastener.

5. The display assembly of claim 3, wherein one of said openings includes an outer end portion in the nature of a countersink that is adapted to receive an enlarged head that is at one end of the screw fastener.

6. The display assembly of claim 3, wherein one of the openings includes internal threads and said screw fastener includes external threads that mate with these internal threads.

7. The display assembly of claim 6, wherein the clamp part that includes the internal threads includes an imbedded nut having an opening, and wherein the internal threads are in said opening.

8. The display assembly of claim 1, wherein said outboard portion is a T-bar.

9. The display assembly of claim 8, wherein the T-bar is oriented to extend substantially vertically when the mounting bracket is clamped onto said edge rail.

10. The display assembly of claim 1, wherein each clamp part includes an outboard portion that is a connector component, and the outboard connector component on the upper clamp part is in alignment with and forms a continuation of the outboard connector component on the lower clamp part when the two clamp parts are connected together.

11. The display assembly of claim 10, wherein the outboard connector components are axial sections of an elongated T-bar.

12. The display assembly of claim 1, comprising an upper space in the upper clamp part, outwardly of the upper clamp jaw, and a lower space in the lower clamp part, outwardly of the lower clamp jaw and below the upper space in the upper clamp part, said spaces together accommodating said edge rail.

13. The display assembly of claim 12, comprising a screw fastener for connecting the upper clamp part to the lower clamp part.

14. The display assembly of claim 13, comprising a mortise and tenon joint where the upper clamp part meets the lower clamp part, positioned to prevent rotation of one clamp part relative to the other clamp part when the clamp parts are connected together by the screw fastener.

15. The display assembly of claim 14, wherein the screw fastener is positioned laterally outwardly of the upper and lower clamp jaws and laterally inwardly of the outboard portion.

16. The display assembly of claim 15, wherein said outboard portion is a T-bar and the display member includes a T-slot for receiving the T-bar.

17. The display assembly of claim 16, wherein the T-bar and T-slot oriented to extend substantially vertically when the mounting bracket is clamped onto to said edge rail.

18. The display assembly of claim 15, wherein each clamp part includes an outboard portion that is a connector component, and the outboard connector component on the upper clamp part is in alignment with and forms a continuation of the outboard connector component on the lower clamp part when the two clamp parts are connected together.

19. The display assembly of claim 18, wherein the outboard connector components are axial sections of an elongated T-bar.

20. The display assembly of claim 19, wherein one of the T-bar sections includes a set screw extending through the T-bar, perpendicular to the general plane of the T-bar.

* * * * *